US007014331B2

(12) United States Patent
Risch et al.

(10) Patent No.: US 7,014,331 B2
(45) Date of Patent: Mar. 21, 2006

(54) LIGHT SYSTEM ON TREES AND OTHER OBJECTS

(76) Inventors: Charles E Risch, 10111 Verona Lakes La., Miromar Lakes, FL (US) 33913; Mary B. Risch, 10111 Verona Lakes La., Miromar Lakes, FL (US) 33913; Brian Joseph Risch, 300 W. Grand #402, Chicago, IL (US) 60610; Eric Steven Risch, 5538 Croydon Ct., Boca Raton, FL (US) 33486

( * ) Notice: Subject to any disclaimer, the term of this patent is extended or adjusted under 35 U.S.C. 154(b) by 51 days.

(21) Appl. No.: 10/867,288

(22) Filed: Jun. 15, 2004

(65) Prior Publication Data

US 2005/0276067 A1 Dec. 15, 2005

(51) Int. Cl.
*F21S 6/00* (2006.01)

(52) U.S. Cl. ..... 362/123; 362/249; 362/252; 362/806; 362/431

(58) Field of Classification Search ..... 362/249, 362/153.1, 382, 250, 252, 123, 396, 430, 362/806, 431, 109, 190
See application file for complete search history.

(56) References Cited

U.S. PATENT DOCUMENTS

| | | | | |
|---|---|---|---|---|
| 4,462,065 A * | 7/1984 | Rhodes | 362/250 |
| 4,620,270 A * | 10/1986 | Laakso | 362/123 |
| 5,357,410 A * | 10/1994 | Cota et al. | 362/109 |
| 5,647,660 A * | 7/1997 | Lee | 362/249 |
| 6,027,233 A * | 2/2000 | Chen | 362/402 |
| 6,203,171 B1 * | 3/2001 | Sherman, Jr. | 362/249 |

* cited by examiner

*Primary Examiner*—John Anthony Ward
*Assistant Examiner*—Jacob Y. Choi

(57) ABSTRACT

A light system to be installed under branches of a tree, particularly under the fronds of a palm tree. The system involves a flexible multiple bulb light rod or a continuous string of lights. A lower end of the light rod is installed to a trunk of a tree by way of a bracket. The upper end of the flexible light rod has one end of a cord attached thereto. The cord is passed along the light rod by way of hooks attached thereon. By pulling at the other free end of the cord the flexible light rod will be bent downwardly to simulate the curvature of a branch on the tree without being attached thereto. The free end of the cord is then tied to a lower end of the bracket. The support rod for the lighting string may be supported on both ends on individual columns to form an arch.

5 Claims, 6 Drawing Sheets

LIGHT SYSTEM ON TREES AND OTHER OBJECTS

CROSS REFERENCE TO RELATED APPLICATIONS (none)

STATEMENT REGARDING FED SPONSORED R & D (none)

BACKGROUND OF THE INVENTION

The present invention relates generally to outdoor tree lighting and other decorations and more particular to a tree lighting system which provides a predetermined lighting pattern within a branch portion of the natural tree. The light system of the invention provides accent lighting that includes decorator flexibility.

BRIEF SUMMARY OF THE INVENTION

The inventive concept, that is, the light system can easily be installed on trees having overhanging branches. That is particularly true on palm trees having a multiple of fronds overhanging the ground. Lighting systems can also be attached to walk ways or terraces. It is known to install lights, especially a string of lights on overhanging branches of trees by tying the same to the branches or by wrapping the same around the branches or fronds. It is very cumbersome, time consuming and it involves expensive equipment such as so called "cherry pickers" or man lifts. The present invention only involves a ladder to attach the light system to a tree. Also, the present invention has a reduced damage potential when a frond falls off and can fill in where fronds are sparse.

DETAILED DESCRIPTION OF THE INVENTION

Figure 1A:
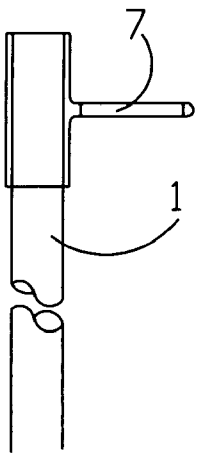
FIG. 1A shows a connector for the string of lights including a hook.
Figure 1:
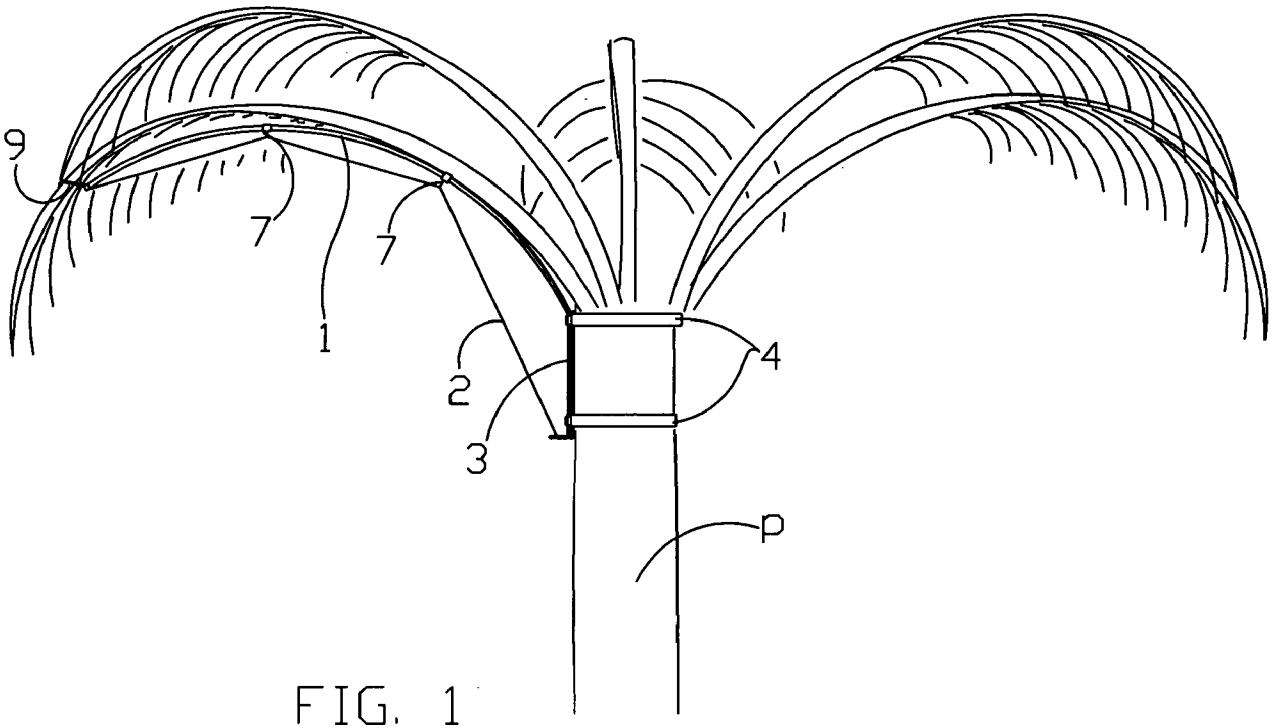
FIG. 1 shows the use of a string of lights attached under a branch of a tree.
Figure 3:
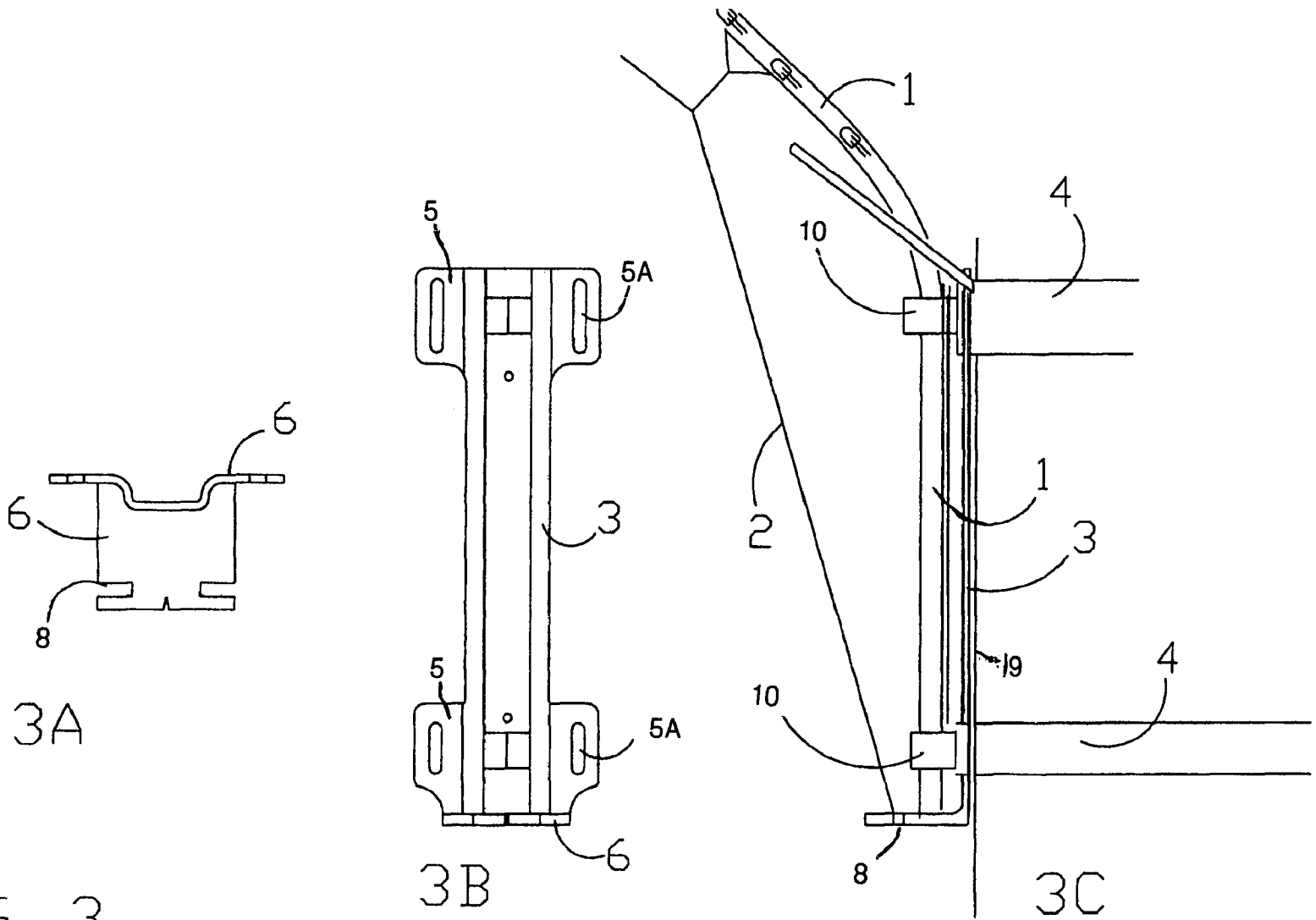
FIG. 3A illustrates a lateral bracket to wind tension cords thereon.
FIG. 3B shows a frontal view of a bracket to mount the lighting system on a tree or any other object.
FIG. 3C illustrates a perspective view of the bracket to mount the lighting system thereon.

FIG. 1 illustrates the inventive light system after it has been installed on a tree, a palm tree P in this example, although any other tree could be used. The rod with string of lights is shown at 1. Any string of lights could be used such as typical Christmas tree lights having individual light bulbs or the string of lights where light bulbs are embedded within a see-through plastic tube. The advantage of using the latter is that they are weather proof, they are obtainable in different thickness and can be used as a string of different lengths and can easily be plugged into each other in an end to end array. The lights can be inserted into a flexible clear plastic tube and the tube is not being fastened to a any branch of the tree or, as is illustrated, to the frond of a palm tree. A flexible rod instead of a tube can also be used to merely fasten a string of lights to an outside of the rod but contiguous thereto. An optional frond guide can be used to keep the lights under the fronds. It is merely necessary to obtain a ladder that is leaned against the trunk of the tree to obtain the desired height so that the bottom of the flexible tube or the flexible rod can be fastened to a bracket 3 which is fastened to the trunk by straps 4 passing through the bracket and around the trunk of the tree. To obtain the desired curvature in the strands of lights and to simulate the curvature of the branch or the frond of the palm tree P, a string or cord 2 is being used which according to the tension applied to the same establishes the desired curvature. The end of the cord 2 is fastened to the outermost end of the rod 1 and by passing the cord through several hooks 7 or eye lets along the length of rod 1 and then by pulling at the other end of the cord 2, the rod will be bent into its desired curvature. When the desired result is obtained, the loose end of the cord will be fastened to the bottom of the bracket 3 which will be more clearly shown in FIG. 3 below. It is also desirable to install a V-shaped guide 9 at the outer end of the flexible rod. The V-shaped guide 9 is embracing the outer end of the rib of the frond to prevent the outer end of the lighting support rod 1 from swaying excessively in a wind but only with the swaying of the frond.

FIG. 1A shows a connector 7 which is useful to connect several light strings together or rods or tubes that support the same to extend the length of the light strings over a greater area. It is also useful to have a hook on the connector 7 attached to or molded into the connector to carry the tensioning cord 2 along the light strings and to aid the same in bending the supporting rod 1 into its desired shape.

Figure 1B:
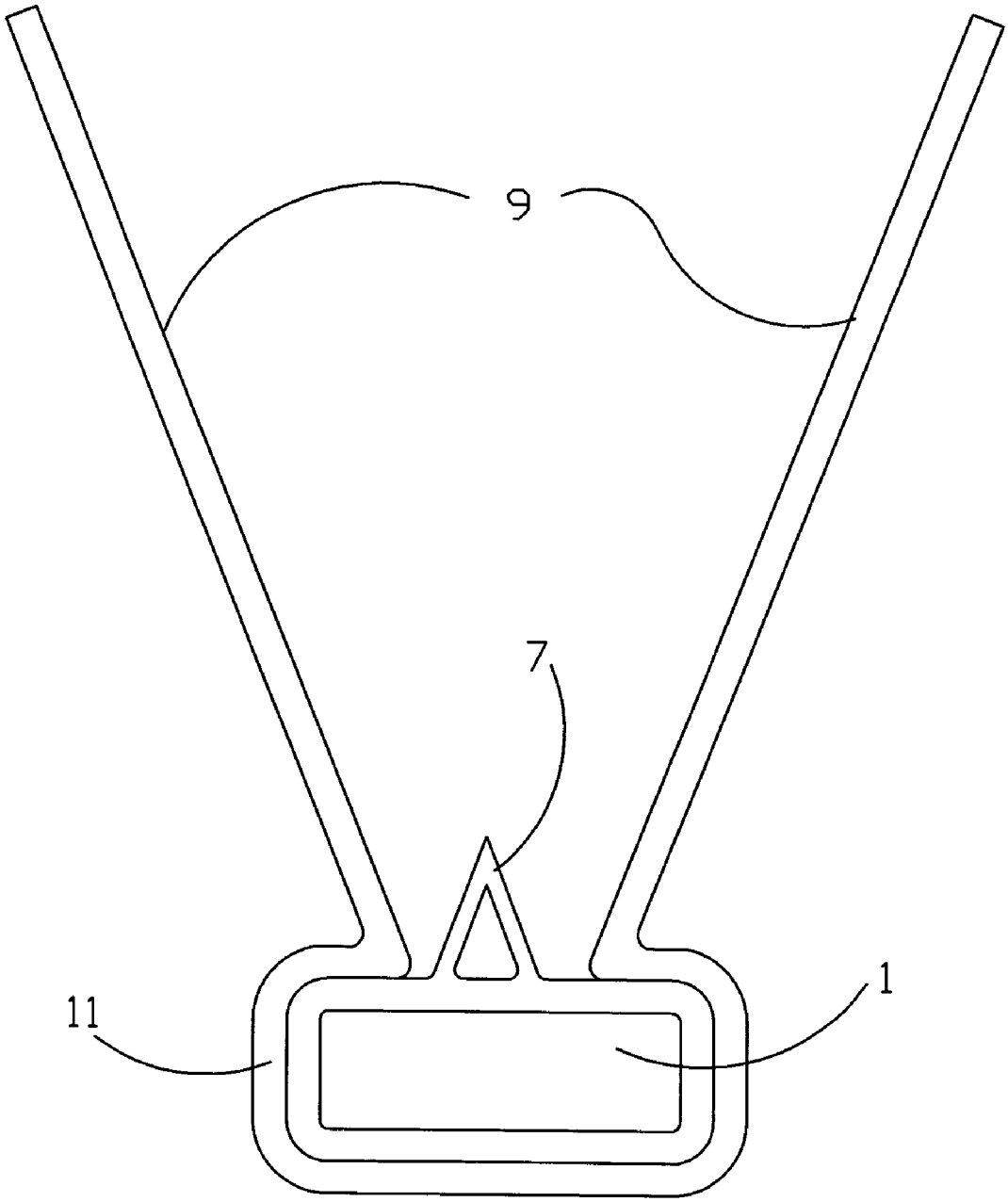
FIG. 1B shows a frond guide in a cross section through a frond's free end and of the lighting string.

FIG. 1B shows the frond guide 9 shown in FIG. 1 at the end of the frond and at the end of the light support rod 1. The guide 9 has two divergent arms 9 that embrace the fronds at the end of the frond branch. This will prevent the fronds to move independently from the string of lights. The closed end 11 surrounds the light supporting rod 1 to thereby stay in close contact with the end of the frond branch. It is also desirable to add a hook 7 to the guide to capture the end of the tension cord 2.

Figure 2:
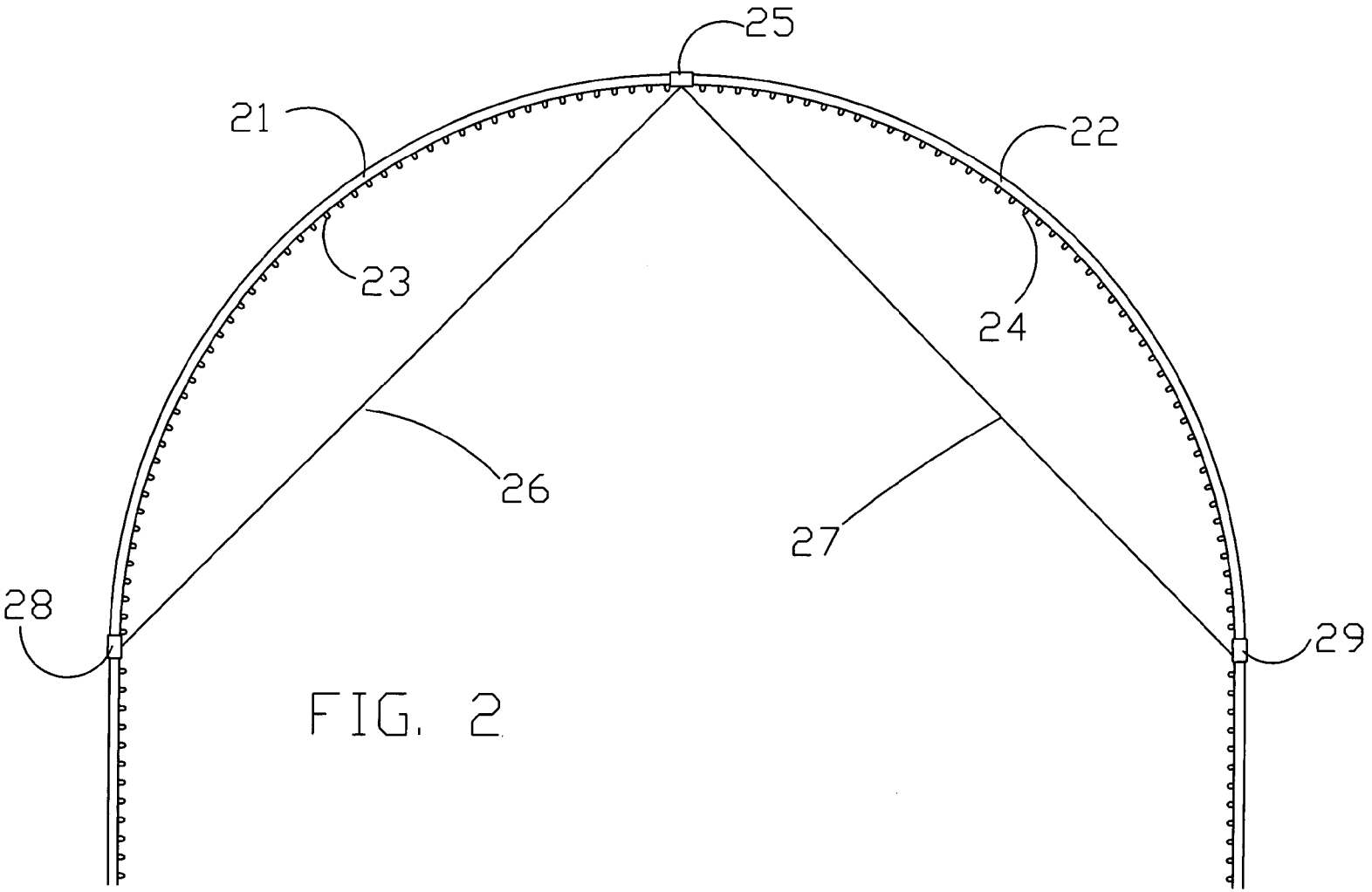
FIG. 2 illustrates a lighting system including an arch to cover walk ways.
Figure 6:
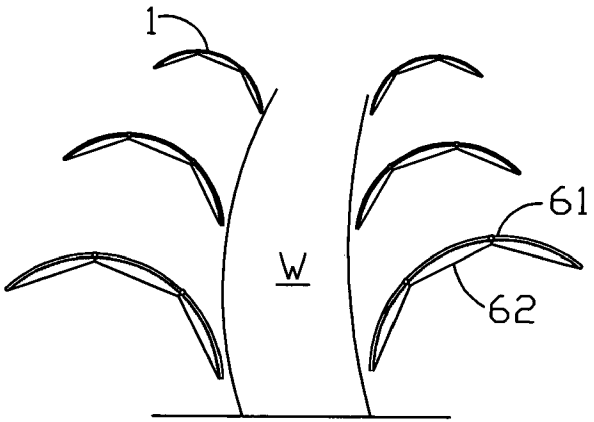
FIG. 6 shows an installation of the lighting system for a walk way but directed in opposite directions.

FIG. 2 illustrates an extended use of the lighting strings 23 and 24. In this embodiment there is formed an arch over a walkway which will be shown below in FIGS. 5 and 6. There are several connectors 25, 28 and 29, similar to the connector shown in FIG. 1A, which connect several lighting strings 21 and 22 together to make them into a long string of lights to extend over a certain terrain such as a walkway. The use of a cord 26 and 27 keeps the arch in a certain predetermined position. In many installations it is preferred that the cords 26 and 27 be subdivided into three sections, as is shown in FIGS. 1 and 6. This way more head room is obtained between the ground and the arch and may look better aesthetically.

FIGS. 3A–3C illustrate details of a bracket useful in mounting the lighting strings on an object such as a tree trunk or part of a building. In FIG. 3C there is shown a perspective view of a bracket 3 having a back plate 3 with extending upper and lower ears having apertures 5 therein. The ears 5 will receive a band or a strap 4, as shown in FIG. 1 and FIG. 3B to fasten the bracket 3 around a trunk of a tree. The bracket 3 further has receptacles 10 so that the flexible rod 1 can be fastened therein, simply by slipping the same there into. The cross-sectional shape of the rod can be round, square or rectangular, as shown. The bottom of the bracket 3 has a forward extension 6 thereon having lateral cuts 8 therein to aid in winding the cord 2 there around when tensioning the cord to form the proper arch in the string of lights.

Figure 4:
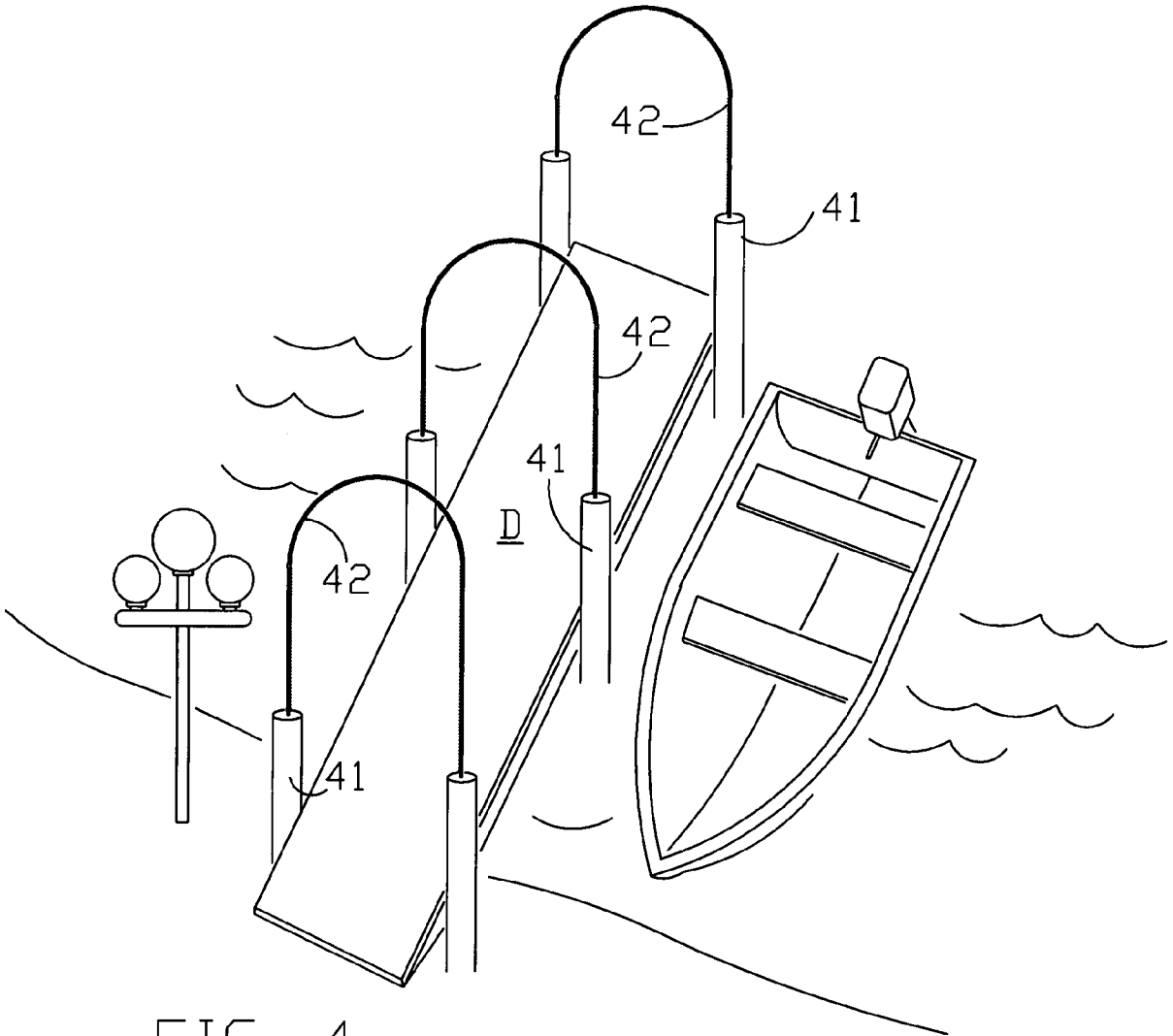
FIG. 4 is an illustration of the lighting system as it is installed on a boat dock.

FIG. 4 is a perspective view of an installation of the lighting system of the invention in combination with a boat dock. In this installation, a boat dock b extends from a dock over the water and next to a boat. To support the lighting system there are a multiple of support columns 41 embedded in the ground or pushed into the water. It is preferred that all columns 41 have an upper end at the same height. This will enhance the aesthetic appearance of the installation. An arch of lights 42 and 1 is installed over the columns 41. The arch of the lights is shown in more detail in FIG. 2.

Figure 5:
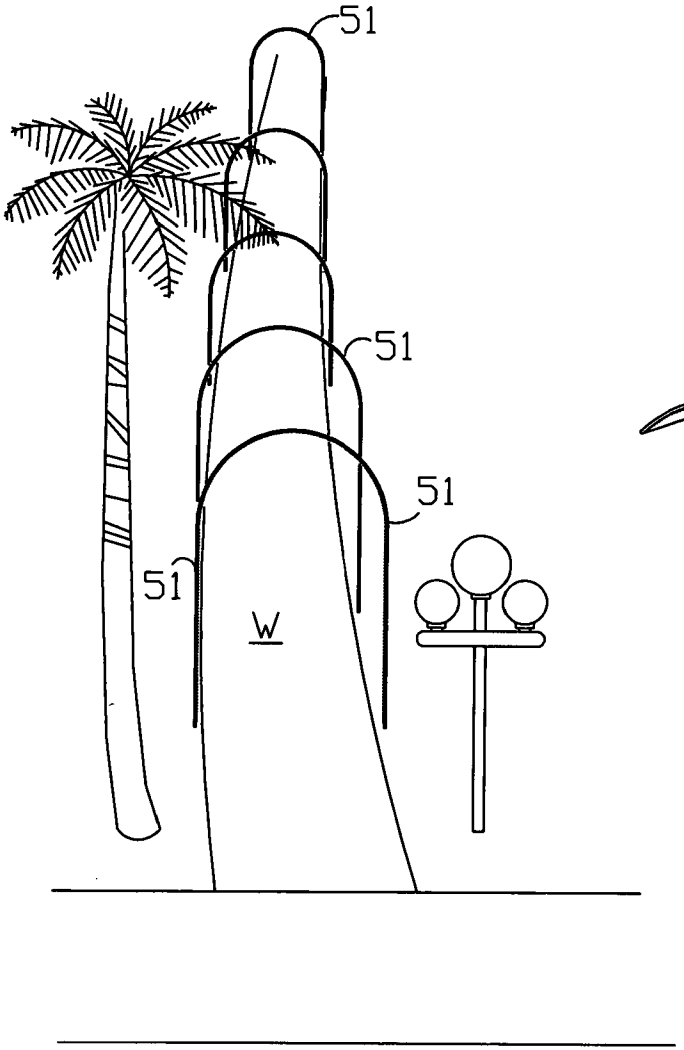
FIG. 5 shows an installation having arches installed over a walk way.

FIG. 5 illustrates the same arrangement as was explained in FIG. 4 except that in this embodiment the lighted arches 51 are installed over a walkway W instead of over a boardwalk b.

FIG. 6 is a similar view as that of FIG. 5 except that the orientation, that is the direction, of the arched lights has been changed. In this embodiment the direction of the arches 61 are reversed in the opposite direction. On the right side of this FIG. 6, the arches 61 are created by the tension cords 62, while on the left side the arches 1 may be created in the manner as was described with regard to FIG. 1.

From all of the above, it is now clear that the inventive light system has a variety of uses. For example, a multiple of systems could be installed in a garden type setting where there is a walkway setting with palm trees planted on both sides of the walkway or other fixed objects. This would lend itself well to a wedding party setting with the bride and groom walking under a horizon of lights.

What is claimed is:

1. In combination with branches of a tree a light system to be installed under said branches of said tree comprising a flexible light rod having a multiple of lights thereon, one inner end of said light rod is being installed in a bracket on the trunk of a tree, the other end of said flexible light rod has one end of a tension cord attached thereto, said tension cord being passed through a multiple of hooks, placed along said light rod, to said inner end of said light rod, means for fastening said cord to said bracket after having been tensioned to create a desired shape.

2. The light system of claim 1, wherein said hooks are eye lets.

3. The light system of claim 1, wherein said bracket is attached to said trunk of said tree by way of straps around said trunk.

4. The light system of claim 1, wherein said bracket has a lower and forward extension for tying said cord to said bracket.

5. The light system of claim 1, wherein said bracket is fastened to a part of a building.

* * * * *